US005772163A

United States Patent [19]

Young

[11] Patent Number: 5,772,163

[45] Date of Patent: Jun. 30, 1998

[54] DEVICE FOR HOLDING AND TIPPING A CONTAINER OF LIQUID

[76] Inventor: Robert P. Young, 7528 S. 2300 East, Salt Lake City, Utah 84121

[21] Appl. No.: 539,730

[22] Filed: Oct. 5, 1995

[51] Int. Cl.[6] ..... A47F 5/12

[52] U.S. Cl. ..... 248/139; 248/311.2; 248/405

[58] Field of Search ..... 248/130, 133, 248/139, 405, 346.06, 346.03, 371, 346.11, 514, 311.2, 142, 131; 211/81

[56] References Cited

U.S. PATENT DOCUMENTS

| | | | |
|---|---|---|---|
| 622,119 | 3/1899 | Clarke . | |
| 715,287 | 12/1902 | Paine | 248/139 |
| 1,459,438 | 6/1923 | Brand | 248/514 |
| 1,977,922 | 10/1934 | Serre | 120/70 |
| 2,084,162 | 6/1937 | Packard | 248/139 |
| 2,297,556 | 9/1942 | Hermann | 248/346.06 |
| 2,576,624 | 11/1951 | Miller | 248/514 |
| 2,596,009 | 5/1952 | Connor et al. | 248/346 |
| 2,748,952 | 6/1956 | Fleit | 211/74 |
| 3,029,058 | 4/1962 | Himler | 248/133 |
| 3,122,257 | 2/1964 | Soehrman | 215/100 |
| 3,220,685 | 11/1965 | Himler | 248/133 |
| 3,469,709 | 9/1969 | Wood | 248/139 |
| 3,555,716 | 1/1971 | Long | 248/514 |
| 3,964,709 | 6/1976 | LaBelle et al. | 248/133 |
| 4,795,117 | 1/1989 | Siteman | 248/146 |
| 5,094,415 | 3/1992 | Revette et al. | 248/133 |
| 5,141,188 | 8/1992 | DeBlasi | 248/142 |

*Primary Examiner*—Alvin C. Chin-Shue
*Assistant Examiner*—Gwendolyn W. Baxter
*Attorney, Agent, or Firm*—Mallinckrodt & Mallinckrodt

[57] ABSTRACT

A device for holding and selectively tipping a container of a liquid into which an implement, such as a brush, is periodically inserted, for removing a portion of the liquid contents, includes a base to be placed on a surface, a receptacle for holding the container, and a hinge joining the receptacle to the base substantially along a side of the receptacle adjacent the base when the receptacle is in upright position on the base. The receptacle can be rotated or tipped about the hinge means to tip the container held in the receptacle. The tension on the hinge is preferably adjustable to adjust the resistance to rotational movement of the hinge. The receptacle is preferably lined with a resilient and compressible material such as plastic foam so that containers of various shapes and sizes may be inserted into the receptacle and held by compressed material.

20 Claims, 2 Drawing Sheets

DEVICE FOR HOLDING AND TIPPING A CONTAINER OF LIQUID

BACKGROUND OF THE INVENTION

1. Field

The invention is in the field of devices for holding and tipping a container of liquid into which an implement for removing a portion of the liquid contents is periodically inserted.

2. State of the Art

There are various times when it is desired to hold a bottle of liquid, such as fingernail polish or paint, at various tipped angles to make the open top of the container more easily accessible to a user for an implement such as a brush to be inserted into the container and, as the level of liquid in the container goes down, to concentrate the liquid therein in a deeper pool at a side of the container to make it easier to remove a portion of the contents of the container with the implement.

Traditionally, when it was desired to tip a container, the container was held in one hand by the user and tipped to the desired angle, while the implement such as a brush was held in the other hand by the user and dipped into the tipped bottle. This procedure uses both of the user's hands. If the bottle continues to be held while the user is depositing the liquid from the brush on the desired surface and concentrating on that task, the bottle may accidentally be tipped too far to spill the liquid. If the container is put down between dippings of the implement, additional time is required to pick up the container, tip it, and allow the liquid contents to run to one side and pool. Further, holding the container to tip it manually is generally inconvenient for the user.

Various devices for holding a container in a tipped position are known. Some of these, such as the device shown in U.S. Pat. No. 3,029,058, holds a container, such as a nail polish bottle, either upright or at one fixed angle, and is not adjustable to various angles as the level of liquid in the container goes down. Other devices, such as that shown in U.S. Pat. No. 3,964,709 allows a bottle to be adjustably held along a range of angles by a resilient material which holds the neck of the bottle, while still other devices such as those shown in U.S. Pat. Nos. 2,596,009, 2,748,952, and 4,795,117 hold the container above a surface so that some type of adjustable swivel device is located between the holder and the surface, such as a table or counter top, so the tipping angle can be adjusted. These devices, however, generally raise the container substantially above the surface on which they would otherwise rest.

For manicurists, it is desirable to be able to hold a bottle of fingernail polish at a constant, but variable, angle and to maintain the bottle as close to its normal height on a surface, such as a countertop, as possible. This allows the manicurist to easily and quickly move a polish brush between the bottle of fingernail polish and the customer's nails. It is difficult to move to a bottle that is held at a substantial height above the counter surface. In addition, it is desirable that the angle of tip be easily adjustable so it can be increased as the level of polish in the container goes down, and that the device be relatively stable on the countertop so the device itself with the container is not easily tipped over to spill the contents of the container if accidently hit by the brush or user. Further, the device should not move easily along the counter top if accidently hit by the brush or user. However, the device should remain compact. Also, since different brands of fingernail polish come in differently shaped bottles, the device should be able to accept and hold a variety of such bottles.

SUMMARY OF THE INVENTION

According to the invention, a device for holding a container of liquid, such as a bottle of fingernail polish or a bottle of paint, into which an implement is periodically inserted, includes a base to be placed on a surface, holding means for receiving and holding the container, and hinge means hingedly interconnecting the holding means and the base with the hinge means located along a side of the holding means adjacent the base so that the holding means is tipped along a side to maintain the holding means and container therein relatively close to the surface on which the base rests. The hinge means is preferably adjustable so the holding means can be moved to various angles as desired and has adjustable tension to adjust the difficulty of moving the holding means with respect to the base and the holding force which holds the holding means in tipped position.

The holding means is preferably adapted to hold a variety of shapes and sizes of containers. In one embodiment, the holding means includes an open top, box-like shell or receptacle, usually of square cross-section of size to accept the largest container to be used therein. A resilient foam material lines the sides of the receptacle and extends inwardly from the sides to provide an opening somewhat smaller than the smallest container to be used. Any of the containers to be used can then be easily pushed into the receptacle and the foam material will be compressed to accept and hold the container within the receptacle.

The base preferably has a non-slip material where it is placed on the supporting surface, and may be weighted to provide additional stability.

THE DRAWINGS

The best mode presently contemplated for carrying out the invention is illustrated in the accompanying drawings, in which:

FIG. 1 is a perspective view of the device of the invention showing a container held therein and in tipped position;

FIG. 2, a side elevation of the device showing the container in upright, untipped position in solid lines, and in tipped position in broken lines; and FIG. 3, a front elevation of the device showing the container in upright, untipped position.

DETAILED DESCRIPTION OF THE ILLUSTRATED EMBODIMENT

In the illustrated embodiment, the device of the invention includes an elongate base 10 which may be molded of a plastic material, or cut from a sheet of plastic or other material, and has a non-slip rubber or cushion plastic material 11 secured thereto as a bottom layer to rest on a surface on which the device is placed. This bottom layer cushions the device on the surface, and stabilizes the device as it resists sliding over the surface.

Figure 3:
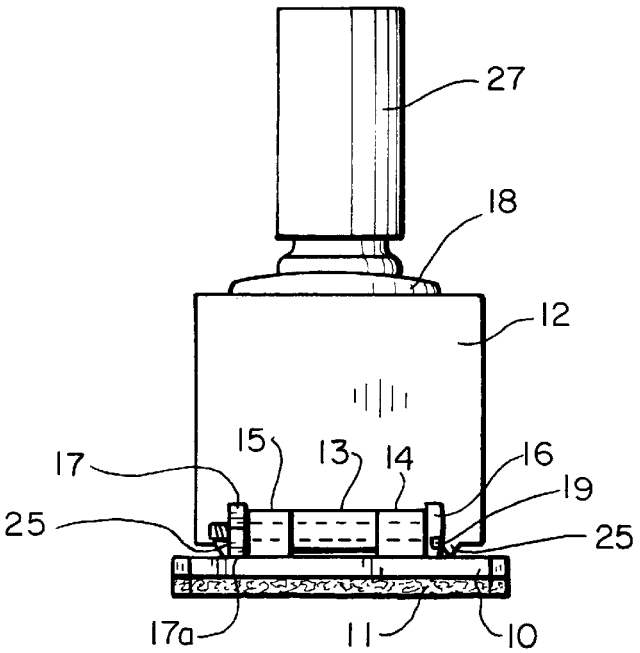

A holding means for a container, here shown as an open top, square cross-section receptacle or box 12, is hinged at a lower side thereof to the base. Hinge element 13 may be integrally molded with box 12 to extend laterally outwardly from a lower side thereof and is configured to be received between a pair of receiving hinge elements 14 and 15 extending upwardly from base 10 near an end thereof, and which may be integrally molded with base 10. A screw 16 extends through hinge elements 14, 13, and 15 to keep them together in alignment and serve as the pivot member for the hinge. Nut 17 is tightened to the end of screw 16 to hold it in place. As seen in FIG. 3, nut 17 is a hex nut positioned so that a flat side 17*a* is substantially against the top of base 10. This prevents nut 17 from rotating as screw 16 is turned.

The hinge elements 13, 14, and 15 will preferably be sized and positioned so that element 13 fits closely but easily between elements 14 and 15. With screw 16 and nut 17 loosely tightened, box 12 may be easily rotated about screw 16, but generally will not remain in a tilted position but fall back to a rest position under the influence of gravity when a container, such as a nail polish bottle 18, is positioned in box 12. However, hinge elements 14 and 15 and base 10 are flexible enough that upon tightening of nut 17 and screw 16, hinge elements 14 and 15 bear against and tighten against hinge element 13 therebetween to increase the friction between the elements. This makes it more difficult to rotate box 12 about screw 16 so that when box 12 is rotated, it will remain in its rotated, tipped position until again moved by a user. In this way, a user can rotate box 12 to any desired position and the box will remain in that position, holding the bottle 18 in the desired tipped position, until it is moved to a new desired position by the user. Nut 17 can be tightened onto screw 16 to any desired degree by the user by means of a normal screwdriver in slot 19 to make it as difficult or as easy as a user desires to rotate box 12.

While the hinge elements 13, 14, and 15 are shown as integrally molded with box 12 and base 10, respectively, it should be realized that separate hinge pieces forming hinge elements may be used and attached in any suitable manner, such as by fasteners or glue, to the box and base, respectively. Further, various types of hinges with various numbers of hinge elements may be used, but it is presently preferred that regardless of the hinge used, the tension on the hinge formed be adjustable. However, in some situation this is not necessary as long as the hinge resists movement to the extent that the box is held in any desired tipped position.

To make the device as stable as possible while still maintaining a relatively small size for the device and lightweight plastic construction, it is desirable to provide additional weight for the base. This may be done by the addition of a weight, such as a steel ball 20, positioned on the base at the end opposite the hinge member. This weight and positioning of the weight, has been found to stabilize the device so it will not easily be tipped over if accidently hit, and in conjunction with the cushion, non-slip base 11, maintains the position of the device on a surface during normal use of the device. Any shape decorative weight could be used. An eleven-sixteenth inch stud ball bearing has been found satisfactory for the weight.

It is desirable to be able to hold a variety of differently sized and shaped containers in box 12. For use with nail polish, some brands of nail polish are supplied in flattened oval shaped bottles as shown at 18, while other bottles may be round, square, or oval shaped of different proportions. It is desirable to be able to accommodate all or most of these bottles in box 12. Thus, box 12 is sized to accept therein the largest bottle to be held and has resilient foam material 22 lining the walls and extending inwardly to form an opening 23 smaller than the smallest bottle to be held. When a bottle or other container is inserted into box 12, it compresses foam material 22. When the bottle is removed, the foam expands to substantially its original size so a bottle of different size and shape can be inserted. The compressed foam material around a bottle holds the bottle in place in box 12, but because it is compressible, various sizes and shapes of containers may be inserted into and held in box 12. It has been found that a box of interior size of one and one-half inches by one and one-half inches with one-quarter inch of foam along the inside walls of the box will hold most presently available nail polish bottles.

Figure 2:
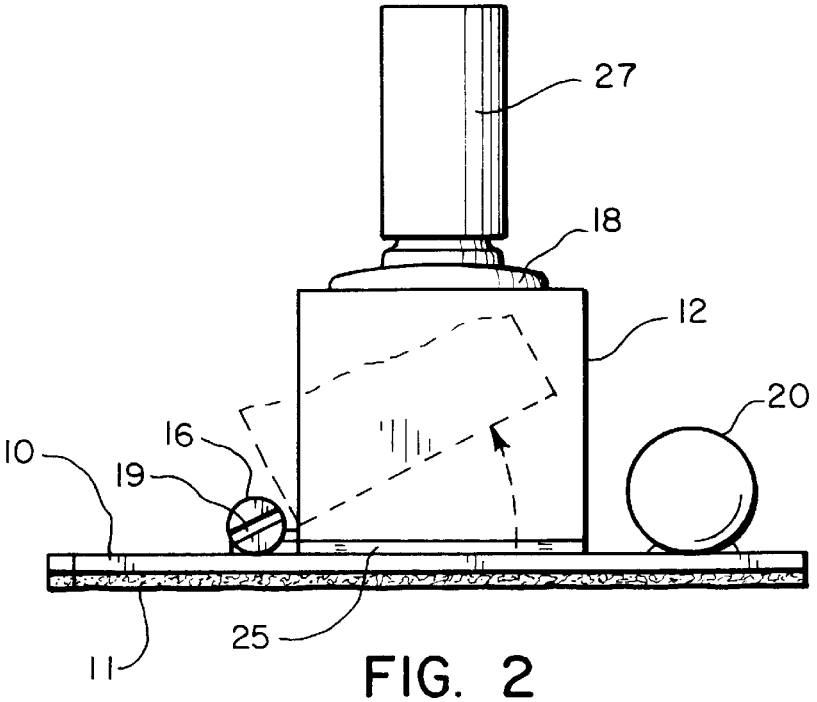

While the flat bottom of box 12 could rest directly on the top of base 10 when box 12 is in upright, untilted position, FIGS. 2 and 3, it is presently preferred to provide two supporting ridges 25 along the bottom of box 12 to contact the top of base 10 and support box 12 thereon. This is advantageous if material spills onto base 10 because it minimizes the area of contact between the bottom of box 12 and top of base 10 to thereby minimize the area that could be stuck together by the spilled materials.

Figure 1:
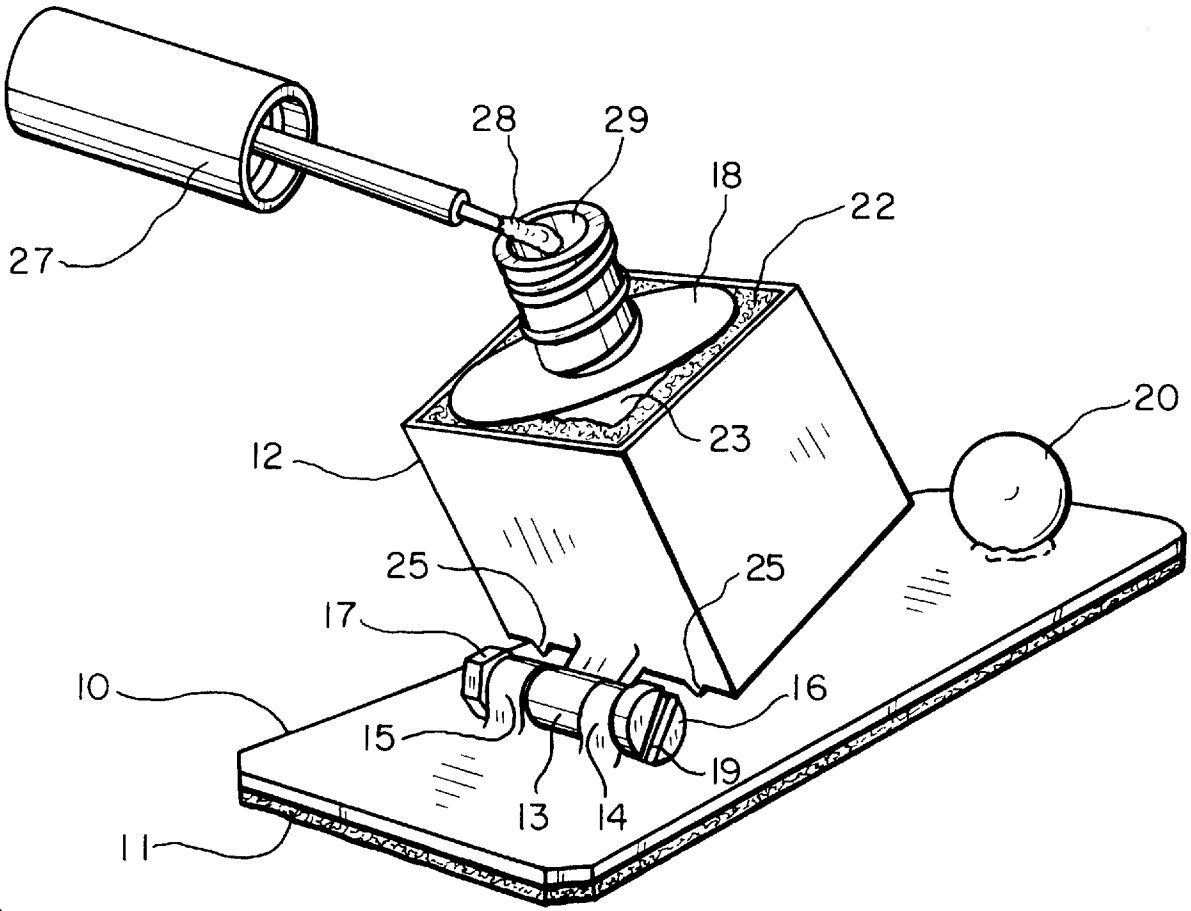

In use, the device is conveniently positioned on a working surface. The desired container of liquid is inserted into box 12 and the top of the bottle removed (the top could be removed before the container is inserted into the box). If not already adjusted, screw 16 is adjusted to provide the desired tension on the hinge. With nail polish, container top 27 which includes a nail polish brush 28 attached thereto, is unscrewed from container 18. When the container is full, box 12 and container 18 therein may be left in a vertical position, or may be tipped to an extent desired by the user to place bottle top opening 29 in a convenient orientation for use. As the liquid in the container is used, box 12 is rotated, such as to a position shown in FIG. 1 and in broken lines in FIG. 2, to pool the liquid at one side of the container to make it easier to get the liquid onto brush 28. As the level drops still further, box 12 and bottle 18 therein may be tilted to a greater degree, as desired, to further pool the liquid and make it easier to get onto brush 28.

Usually it will be desirable to have the hinge tightened to an extent to hold box 12 in any position to which it is tipped. However, in some instances a user may want to keep the hinge loose so the user can tip the bottle with the brush inside or as the brush is removed, but the bottle will thereafter return to upright, untipped position for the, next use. When the hinge is loose so the bottle is easily tipped, if tipped too far, the box and container therein can tip completely forwardly rather than returning to upright position. This generally will not happen in normal use since the bottle will not usually be tipped that far.

As can be seen from the drawings, the base is relatively thin, as is the bottom of holding means and the supporting ridges. This means that the top of a bottle or other container placed in the holder in upright position is only a small distance higher than it would be resting directly on the surface without the device of the invention. In a prototype of the device of the invention, the base with non-slip cushion is about three-sixteenths of an inch thick. The holder or box 12 is made of one-sixteenth inch plastic and the hinge attachment, not integral on the prototype, which acts as support ridges where it is glued to the bottom of the holder, spaces the holder about one-eighth inch above the base. Thus, the container is about one-half inch higher than it would be sitting directly on the surface. Molded hinges would reduce this height difference. The location of the hinge joining the holder to the base at a side of the holder rather than underneath the holder allows the bottom of the holder to remain on the base in upright position, and allows this minimum increase in height. It also provides for minimal variation in height as the container is initially tipped, with a reduction in height at greater angles of tip.

A particular advantage of the device of the invention with the placement of the hinge along a lower side portion of the holding means adjacent the base is that the holding means, and thus the containers held therein, are maintained as closely as possible to the surface upon which the device is placed, with the top of the container not much higher than it would be if the container was resting directly on the surface. This is an important consideration to many users, particularly to manicurists who want the top of the nail polish container at the level they are accustomed to in order to maintain their efficiency.

It has been found that the device of the invention is quite stable, resisting tipping over of the device if accidentally hit during use. Of course, the wider the base, the more resistant to tipping sideways it will be, but for ordinary nail polish bottles, with a container holder one and five-eights inch square in cross-section and one and one-half inches high, a base one and seven-eighths inch wide and four and one-quarter inches long has been found satisfactory to provide good stability. Various other dimensions will be satisfactory depending upon the containers to be held and the materials used in construction of the device.

While the device has been described as made of plastic material, various other materials can be used. If a heavier material is used for the base, it may not be necessary to add a weight to the base.

Whereas this invention is here illustrated and described with reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A device for holding and selectively tipping a container of liquid which has a top and an opening in the top into which an implement for removing a portion of the liquid contents is periodically inserted, comprising a substantially planar base to be placed on a surface; an open top receptacle having a resilient foam material therein for receiving and holding the container with the top of the container oriented with the top of the receptacle; at least one receptacle hinge element secured to the receptacle at a side of the receptacle adjacent the base; at least one base hinge element secured to the base; and hinge pin means extending through the respective hinge elements to hingedly and adjustably secure them together, whereby the receptacle is hingedly connected to the base so that the receptacle can be tipped with respect to the base about the hinge pin substantially along a lower side of the receptacle and the resistance to movement of the hinge means is adjustable.

2. A device for holding a container of liquid according to claim 1, wherein the hinge pin means is a screw and nut wherein the nut may be adjustably tightened to adjust the resistance to movement of the hinge means.

3. The device for holding a container of liquid according to claim 2, wherein one of the at least one base hinge element and the at least one receptacle hinge element includes more than one hinge elements and the other of the at least one base hinge element and receptacle hinge element fits between the more than one hinge elements.

4. The device for holding a container of liquid according to claim 2, wherein the at least one base hinge element secured to the base is two hinge elements secured to the base in spaced apart relationship and the at least one receptacle hinge element secured to the receptacle is a single hinge element secured to the receptacle and sized to fit between the two spaced hinge elements secured to the base, and wherein tightening of the screw and nut combination squeezes the hinge element secured to the receptacle between the two hinge elements secured to the base to adjust the resistance to movement of the hinge means.

5. A device for holding a container of liquid according to claim 1, wherein the base includes a non-slip bottom surface.

6. A device for holding a container of liquid according to claim 1, additionally including a weight secured to the base.

7. A device for holding a container of liquid according to claim 6, wherein the base is elongated with opposite ends, the at least one hinge member secured to the base extends from the elongate base near one end, and the weight secured to the base is secured near the opposite end.

8. The device for holding a container of liquid according to claim 1, wherein the receptacle is configured to hold a variety of shapes and sizes of container.

9. The device for holding a container of liquid according to claim 8, wherein the receptacle is of interior size to accept the largest container to be held therein, and includes the resilient foam material in the receptacle lines and the receptacle and extend inwardly to leave an opening smaller than the smallest container to be held therein, whereby, when a container is inserted into the receptacle, the resilient foam material compresses to accept and hold the container.

10. A device for holding a container of liquid according to claim 9, wherein the resilient foam material is a plastic foam material.

11. The device for holding a container of liquid according to claim 10, wherein the receptacle is of box configuration with an open top.

12. The device for holding a container of liquid according to claim 11, wherein the box configuration is a rectangular box configuration.

13. The device for holding a container of liquid according to claim 12, wherein the box configuration has sides and a bottom and the sides are of equal size.

14. The device for holding a container of liquid according to claim 13, wherein the receptacle has a lower edge, and wherein the hinge means located at a side of the receptacle adjacent the base is located adjacent the lower edge of the receptacle.

15. The device for holding a container of liquid according to claim 1, wherein the receptacle is of box configuration.

16. The device for holding a container of liquid according to claim 15, wherein the box configuration is a rectangular box configuration.

17. The device for holding a container of liquid according to claim 16, wherein the box configuration has sides and a bottom and the sides are of equal size.

18. The device for holding a container of liquid according to claim 17, wherein the receptacle has a lower edge, and wherein the hinge means located at a side of the receptacle adjacent the base is located adjacent the lower edge of the receptacle.

19. A device for holding and selectively tipping a container of liquid which has a top and an opening in the top into which an implement for removing a portion of the liquid contents is periodically inserted, comprising a substantially planar base to be placed on a surface; an open top receptacle having a resilient foam material therein for receiving and holding the container with the top of the container oriented with the top of the receptacle, the receptacle having a bottom and side walls extending from the bottom with a bottom edge being formed where the bottom and side walls meet; and hinge means located adjacent the bottom edge of the receptacle hingedly connecting the receptacle to the base so that the receptacle is located and exposed above the base and can be tipped with respect to the base about the hinge means substantially along a bottom edge of the receptacle.

20. The device for holding a container of liquid according to claim 19, wherein the base is elongate with opposite ends, the at least one hinge member secured to the base extends from the elongate base near one end, and additionally including a weight secured to the base near the opposite end.

* * * * *